United States Patent [19]

Tsuneda

[11] 3,977,983

[45] Aug. 31, 1976

[54] LIQUID DEVELOPER FOR USE IN DEVELOPMENT OF AN ELECTROSTATIC LATENT IMAGE COMPRISING A COPOLYMER CONTAINING AN AMINO GROUP CONVERTED INTO A QUATERNARY AMMONIUM SALT OR HYDROXIDE

[75] Inventor: Terukuni Tsuneda, Yokohama, Japan

[73] Assignee: Canon Kabushiki Kaisha, Tokyo, Japan

[22] Filed: May 8, 1975

[21] Appl. No.: 575,719

[30] Foreign Application Priority Data

May 17, 1974 Japan ..... 49-55743

[52] U.S. Cl. ..... 252/62.1 L; 526/23; 526/30; 526/46

[51] Int. Cl.[2] ..... G03G 9/12

[58] Field of Search ..... 252/62.1; 260/31.8 R; 526/23, 30, 46

[56] References Cited

UNITED STATES PATENTS

| | | | |
|---|---|---|---|
| 3,585,140 | 6/1971 | Machida et al. | 252/62.1 L |
| 3,729,418 | 4/1973 | Machida et al. | 252/62.1 L |
| 3,874,896 | 4/1975 | Machida et al. | 252/62.1 L |
| 3,893,935 | 7/1975 | Jadwin et al. | 252/62.1 |

*Primary Examiner*—Mayer Weinblatt
*Assistant Examiner*—John D. Smith
*Attorney, Agent, or Firm*—Fitzpatrick, Cella, Harper & Scinto

[57] ABSTRACT

A liquid developer for use in development of an electrostatic latent image comprising an electrically insulating carrier liquid and a toner dispersed therein comprises a copolymer wherein the amino group thereof is converted into a quaternary ammonium salt or a quaternary ammonium hydroxide as a chargeability controlling agent for controlling the toner so as to be negative chargeable. The copolymer is prepared from at least three kinds of the specified monomers.

8 Claims, No Drawings

LIQUID DEVELOPER FOR USE IN DEVELOPMENT OF AN ELECTROSTATIC LATENT IMAGE COMPRISING A COPOLYMER CONTAINING AN AMINO GROUP CONVERTED INTO A QUATERNARY AMMONIUM SALT OR HYDROXIDE

BACKGROUND OF THE INVENTION

1. Field of the Invention

This invention relates to a liquid developer for use in development of an electrostatic latent image in electrophotography, electrostatic printing and the like.

2. Description of the Prior Art

Heretofore, a liquid developer used for development of an electrostatic latent image in electrophotography and the like has been generally prepared in such a manner that a pigment, dye and the like are kneaded along with a resin, a dispersing agent, a chargeability controlling agent, a solvent and the like and the resulting paste-like kneaded material is dispersed in a highly insulating carrier liquid. The above-mentioned dispersing agent and chargeability controlling agent are very important components which are used for the purpose of improving the chargeability, dispersion stability and preservation stability of the toner particles in the liquid developer. As such dispersing agent and chargeability controlling agent, linseed oil, soybean oil, rosin, asphalt and the like have been so far used. However, these natural products are not always constant in their compositions and therefore it has been very difficult to prepare a liquid developer having always a constant property. Further, the liquid developer prepared by using those natural products has had many drawbacks, for example, the dispersibility of the toner particles in the liquid developer becomes poor and the charge polarity of the toner becomes unclear during use and preservation thereof for a long period of time.

As a method of controlling the polarity of the toner in the liquid developer, a method of controlling the charged state of the toner in which a surface active agent is dissolved in the carrier liquid of the liquid developer to cause it to adsorb on the toner has been known, in addition to a method of applying various natural products onto the surface of the pigment particles as mentioned above. As the surface active agent used for the above purpose, there may be mentioned numerous materials, for example, a metal soap such as cobalt naphthenate, nickel naphthenate, manganese naphthenate and the like, a metal alkylbenzensulfonate and a phosphatide such as lecithin, cephalin and the like, but due to various manners of use thereof, their effects are varied. Generally, these surface active agents are those having a lower electric resistance, and therefore they lower the electric resistance of the carrier liquid when they are dissolved in such carrier liquid. Consequently, the surface active agent should be dissolved in the carrier liquid to such an extent that it does not destroy the electrostatic latent image having been formed on a photosensitive member, on account of which the amount of the surface active agent to be added is subjected to strict restriction. In view of this, such method using the surface active agent is considered to be defective in that the surface active agent can not be added to the carrier liquid in an amount sufficient to control the chargeability of the toner in the liquid developer.

The materials having been so far used for the purpose of controlling the toner so as to be negatively chargeable by dissolving them in the carrier liquid are very few, and only lecithin, an alkylbenzenesulfonate, a polyamide resin and the like are known. When these materials are used as a chargeability controlling agent in preparing a liquid developer, a sufficiently high interfacial potential can not be imparted to the toner, and such materials generally change in their qualities owing to the oxidation, for example the contact with air while allowed to stand, the oxidizing function of the other components in the toner composition and the oxidizing function of the ozone and the like generating upon corona charging in operation of a copying machine. Further, the chargeability controlling property of such materials is deteriorated due to the materials dissolving out from the photosensitive paper, transferring paper or electrostatic recording paper at the time of the development. In consequence of this, the image density and sharpness of the developed image are liable to lower, and the liquid developer containing such material has had the drawback that it can not be used for a long period of time.

SUMMARY OF THE INVENTION

It is a primary object of this invention to provide a novel liquid developer for use in development of an electrostatic latent image which is of negative chargeability and free from the above-mentioned drawbacks.

It is another object of this invention to provide a liquid developer for use in development of an electrostatic latent image in which a negatively chargeable chargeability controlling agent capable of being well soluble in the carrier liquid and imparting a sufficient chargeability to the toner particles without lowering the electric resistance of the carrier liquid is dissolved in the carrier liquid.

It is a further object of this invention to provide a liquid developer for use in development of an electrostatic latent image which is excellent in the oxidation resistance property and capable of giving a sharp image free from fog even when it is used for a long period of time.

The present inventor has carried out the experiment with respect to the effect of various polymers and copolymers on the toner particles, for example, the chargeability controlling property, oxidation resistance property and preservation stability by dissolving them in the carrier liquid of the liquid developer. As the result of the experiment, it has been found that a quaternary ammonium salt prepared by treating the amino group of the copolymer mentioned below with an alkylating agent as well as a quaternary ammonium hydroxide prepared by treating the quaternary salt with a hydroxide are capable of rendering the toner particles remarkably negatively chargeable, and thereby giving a sharp image free from fog which is excellent in the image density and the resolution power even when the liquid developer containing such quaternary ammonium products is used for a long period of time.

According to the present invention, there is provided a liquid developer for use in development of an electrostatic latent image comprising an electrically insulating carrier liquid and a toner dispersed therein, the liquid developer comprising a copolymer wherein the amino group thereof is converted into a quaternary ammonium salt or a quaternary ammonium hydroxide, the copolymer being composed of at least one member selected from the monomers of the following formula (1), at least one member selected from the monomers of the following formula (2) and at least one member selected from the monomers of the following formula (3), Formula (1):

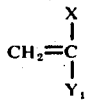

wherein X is selected from the class of —H and —$CH_3$ and $Y_1$ is selected from the class of —$C_nH_{2n+1}$, —$OC_nH_{2n+1}$ and —$COOC_nH_{2n+1}$, in which $n$ is a positive integer.

Formula (2):

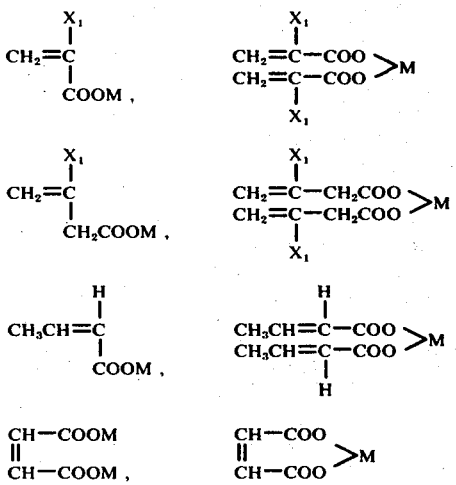

wherein $X_1$ is selected from the class of —H, —$CH_3$ and —COOM and M is selected from the class of an alkali metal and alkaline earth metal.

Formula (3):

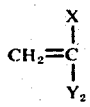

wherein X is selected from the class of —H and —$CH_3$ and $Y_2$ is selected from the class of the following substituents:

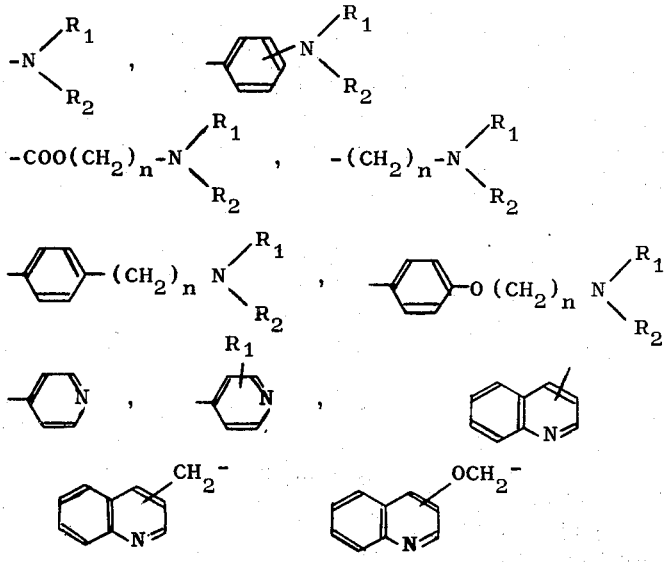

wherein 1 $n$ 4; $R_1$ and $R_2$ are similar or dissimilar, selected from the class of —H and —$C_mH_{2m+1}$; and 1 $m$ 4.

DESCRIPTION OF THE PREFERRED EMBODIMENTS

The carrier liquid to be used for the liquid developer according to this invention may be that having been used so far for a conventional liquid developer for electrophotography, and an organic solvent having a volume resistivity of $10^9$ohm-cm or above and a dielectric constant of 3 or less is preferably used. In such organic solvent are included paraffinic hydrocarbons, isoparaffinic hydrocarbons, alicyclic hydrocarbons, halogenated hydrocarbons and the like, more particularly there may be mentioned n-heptane, cyclohexane, dipentene, lampoil, kerosene, mineral spirit, tetralin, perchloroethylene, trichlorotrifluoroethane and the like.

As the toner to be dispersed in the carrier liquid, the finely pulverized pigment or kneaded mixture of a binder resin and a pigment may be used.

As the pigment to be used, there may be mentioned the following:

| | |
|---|---|
| Mogul A | |
| Elftex 5 | |
| Elf Vulcan XC | (trade names for products of Godfrey L. Cabot Inc. U.S.A.) |
| Statex | (trade name for a product of Columbia Carbon Co., U.S.A.) |
| Carbon Black XC-550 | (trade name for a product of Asahi Carbon K.K., Japan) |
| Carbon Black No. 44 | |
| Carbon Black No. 100 | (trade names for products of Mitsubishi Kasei K.K., Japan) |

Mogul A, Elftex 5, Elf Vulcan XC, Statex, Carbon Black XC-550, Carbon Black No. 44 and Carbon Black No. 100 are all carbon blacks and their Color Index Number is CI 77266.

| | | |
|---|---|---|
| Benzidine Yellow GNN | C.I. | 21090 |
| Benzidine Orange | " | 21110 |
| Scarlet KR | " | 15865 |
| Fast Red | " | 23050 |
| Brilliant Carmine 6B | " | 15850 |
| Sky Blue | " | 77368 |
| Cyanine Blue FG | " | 74160 |
| Phthalocyanine Green LL | " | 74260 |
| Victoria Blue | " | 42595 Lake |
| Spilon Black | " | Solvent Black 22 |
| Spilon Orange | " | Solvent Orange 37 |
| Spilon Red | " | Solvent Red 83 |
| Oil Blue | " | 74350 |
| Vari Fast Blue | " | 42595 |
| Spirit Black | " | 50415 |
| Alkali Blue | " | 42750 |
| Aniline Black | " | 50440 |
| Cyanine Blue NSG | " | 74250 |
| Fast Rose 836 | " | 45170 |
| Benzidine Yellow 471 | " | 21095 |
| Fanal Pink | (C.I. No. 45160) | |
| Heliogen Blue | (C.I. No. 74100) (trade names for products of Badische Anilin & Soda Fabrik A.G.) | |
| Victoria Blue LAKE) | (C.I. No. 42595 Lake) | |
| Lionogen Magenta R | (C.I. No. 46500) (trade names for products of Toyo Ink K.K.) | |
| Cromophtal Blue 4G | (C.I. No. 74160) (trade name for a product of Ciba Ltd.) | |
| Seikafast Carmine 6B | (C.I. No. 15850) | |
| Seikalight Rose R-40 | (C.I. No. 45160) | |
| Seikalight Blue A612 | (C.I. No. 74200) | |
| Seikafast Yellow H7055 | (C.I. No. 21090) | |
| Seikafast Yellow GT-2400 | (C.I. No. 21105) (trade names for products of Dainichi Seika K.K.) | |

These pigments are used for the purpose of coloring the toner particles and it is clear that all the pigments heretofore used for a toner are applicable to this invention.

As the binder resin to be mixed with the above-mentioned coloring powders which is used mainly for the purpose of imparting the fixability, dispersibility and transferability to the toner, the resins heretofore used for a toner are usable. More particularly, the use of the following resins is preferable.

For example, polyvinyl chloride, polyvinylidene chloride, a vinyl chloride-vinylidene chloride copolymer, a chlorinated polypropylene, a vinyl chloride-vinyl acetate copolymer, a vinyl chloride-vinyl acetate-maleic anhydride copolymer, rubber hydrochloride, cyclized rubber, wax rubber, ethyl cellulose, nitro cellulose, polyacrylic acid ester, linseed oil modified alkyd resin, polyvinyl acetate, polyamide resin, cumarone resin, dammar resin, colophonium modified phenolic resin, ketone resin, maleic acid resin, polystyrene, low molecular polyethylene, colophonium, copal, stebelite ester, phenol modified pentaerythritol ester and the like are usable.

The copolymer to be used in this invention for the purpose of controlling the toner so as to be negatively chargeable may be synthesized in the following manner.

At least one member selected from the monomers of the foregoing formula (1), at least one member selected from the monomers of the formula (2) and at least one member selected from the monomers of the formula (3) are subjected to solution polymerization or bulk polymerization in the presence of a polymerization initiator such as azoisobutyronitrile, benzoyl peroxide and the like in a nitrogen gas atmosphere. The amino group of the resulting copolymer is treated with an alkylating agent to form a quaternary ammonium salt. The quaternary ammonium salt is further treated with a hydroxide to form a quaternary ammonium hydroxide. The quaternary ammonium salt or hydroxide is used for the above-mentioned purpose.

In addition, the copolymer may be synthesized by copolymerizing at least one member selected from the monomers of the formula (1), at least one member selected from the monomers of the formula (2) and at least one member selected from the monomers of the formula (3) in which the amino group is converted into a quaternary ammonium salt or a quaternary ammonium hydroxide.

Among the monomers of the formula (1) are included vinyl laurate, vinyl oleate, vinyl stearate, dodecyl acrylate, octyl acrylate, stearyl acrylate, tridecyl acrylate, hexadecyl acrylate, dodecyl methacrylate, heptadecyl methacrylate, stearyl methacrylate, lauryl vinyl ether, n-octyl vinyl ether, tridecyl vinyl ether and the like.

Among the monomers of the formula (2) are included sodium acrylate, potassium acrylate, lithium acrylate, sodium methacrylate, potassium methacrylate, lithium methacrylate, sodium itaconate, potassium itaconate, lithium itaconate, sodium crotonate, potassium crotonate, lithium crotonate, sodium maleate, potassium maleate, lithium maleate, calcium acrylate, barium acrylate, calcium methacrylate, barium methacrylate, calcium itaconate, barium itaconate, calcium crotonate, barium crotonate, calcium maleate, barium maleate and the like.

Further, among the monomers of the formula (3) are included aminostyrene, allylamine, allyl methylamine, N-methylaminoethyl acrylate, N-ethylaminoethyl acrylate, N-methylaminoethyl methacrylate, N-ethylaminoethyl methacrylate, N,N-dimethlaminovinyl, N,N-dimethylaminoethyl acrylate, N,N-diethylaminoethyl acrylate, N,N-dimethylaminoethyl methacrylate, N,N-diethylaminoethyl methacrylate, N-vinyl pyridine, 2-vinyl-5-methyl pyridine, dimethylaminoethyl styrene, N-methylaminoethyl styrene, dimethylaminoethoxy styrene, 2-vinyl quinoline, 4-vinyl quinoline, 2-allyl quinoline, 4-allyl quinoline and the like.

The alkylating agent used for the purpose of treating the amino group as mentioned above to form a quaternary ammonium salt may be the same as that heretofore known. As the examples thereof, there may be mentioned methyl iodide, ethyl iodide, methyl bromide, ethyl bromide, methyl chloride, ethyl chloride, dimethyl sulfate, diethyl sulfate, methyl p-toluene sulfonate, ethyl p-toluene sulfonate and the like. The quaternary ammonium salt may be further formed into a quaternary ammonium hydroxide by means of a substitution reaction using a hydroxide such as silver hydroxide, potassium hydroxide and the like.

The quaternary ammonium salt and quaternary ammonium hydroxide formed by quaternizing the amino group of the copolymer prepared from the monomers of the formulae (1), (2) and (3) are well soluble in the carrier liquid and excellent in the chemical stability, for example in the oxidation resistance property and further, it exhibits the property of remarkably rendering the toner negatively chargeable. In the copolymer, the monomer of the formula (1) is considered to increase the solubility of the copolymer in the carrier liquid. When the monomer of the formula (1) containing an alkyl group having 8–20 carbon atoms is used, the copolymer exhibits a preferable solubility in the carrier liquid. The monomers of the formulae (2) and (3) exhibit the function of controlling the chargeability. In particular, the quaternary ammonium product formed by quaternizing the amino group shown in the formula (3) exhibits strong chargeability and they have been found to render the toner particles negatively chargeable and increase the effect with respect to the oxidation resistance property and preservation stability. The ratio of the monomers of the formulae (1), (2) and (3) which constitute the copolymer can be changed in various ranges depending upon the monomers to be selected. However, it is necessary for the copolymer to contain a monomer of the formula (1) in a mole ratio of such an extent that the solubility of the copolymer in the carrier liquid does not decrease.

Even a small amount of a monomer of the formula (2) has an effect of controlling the toner particles so as to be negatively chargeable, and the amount of the monomer may be increased to such an extent that the solubility of the copolymer in the carrier liquid is not lost. Also even a small amount of the monomer of the formula (3) has a considerable effect and it can be used in a mole ratio of such an extent that the solubility of the copolymer in the carrier liquid is not reduced.

The copolymer to be used in this invention exhibits an effect even when a small amount thereof is dissolved in the carrier liquid of the liquid developer. For example, when about 0.001 g. or more of the copolymer is dissolved in 1 liter of the carrier liquid, its effect can be recognized. The copolymer is weak in the property of lowering the electric resistance of the carrier liquid so that a considerable large amount thereof may be dissolved in the carrier liquid and the amount may be selected within such a range that the lowering of the electric resistance of the carrier liquid is allowable. The deterioration of the property of the resulting liquid developer due to the variation of the amount of the copolymer is not recognized. However, it is desired to use the copolymer in an amount ranging from 0.001 to 10 g., preferably 0.005 to 1.0 g. per one liter of the carrier liquid, which is advantageous from an economical point of view, and further no electric resistance of the carrier liquid lowers.

The invention will be understood more readily by reference to the following examples. However, these examples are intended to illustrate the invention and are not to be construed to limit the scope of the invention.

EXAMPLE 1

In a 500 ml. four-necked flask were placed 400 ml. of 10% water-containing dioxane (10% water and 90% dioxane), 0.2 mole of stearyl methacrylate, 0.1 mole of dimethylaminoethyl methacrylate, 0.1 mole of potassium methacrylate and 0.01 mole of $\alpha,\alpha'$-azobisisobutyronitrile and the air in the flask was sufficiently replaced with nitrogen gas. The mixture was then stirred at 85°C for 8 hours to allow it to cool. The reaction solution was concentrated under a reduced pressure and 20% water-containing methanol was added to cause the oily reaction product to separate out, and subsequently it was dried. The reaction product was dissolved in benzene to cause it to separate out by means of methanol so that the purification of the product was carried out. Such purification procedure was repeated twice to obtain a copolymer-A.

The copolymer-A was dissolved in 200 ml. of toluene and 0.2 mole of methyl p-toluenesulfonate was added thereto, the mixture of which was stirred at 90°C for 8 hours. The reaction solution was concentrated under a reduced pressure and methanol was added to cause the product to separate out so that a copolymer-B according to this invention was obtained.

The copolymer thus obtained was analyzed by means of infrared spectroscopic analysis, nuclear magnetic resonance (NMR), elementary analysis and emission spectroanalysis to confirm that it was a copolymer of stearyl methacrylate, potassium methacrylate and trimethylammonio ethylmethacrylate.

In a roll mill, 39 g. of Carbon Black, 200 g. of XPL2005 (trade name for a polyester resin of Kao Atlas K.K.) and 40 g. of Piccolyte (trade name for a polyterpene resin of Esso Standard Oil Co.) were kneaded and 30 g. of the kneaded material was dispersed in 800 g. of Isopar H (trade name for an isoparaffin type hydrocarbon of Esso Standard Oil Co.) along with 40 g. of Piccolyte S-115 (trade name for a polyterpene resin of Esso Standard Oil Co.) and 180 g. of a 20% solution of Solprene 1205 (trade name for a styrene-butadiene copolymer of Asahi Kasei K.K.) in toluene by means of an attritor (a dispersing device) for three hours. 30 ml. of the resulting dispersed material and 0.05 g. of the copolymer-A as mentioned above were dispersed in 800 g. of Isopar H to prepare a liquid developer *a* for comparison. On the other hand, 0.05 g. of the copolymer-B obtained in the foregoing was dispersed in 800 g. of Isopar H along with 30 ml. of the above-mentioned dispersed material to prepare a liquid developer *b* according to this invention. Furthermore, sodium dodecylbenzenesulfonate was used in place of the copolymer-B in the same amount to prepare a liquid developer *c* for comparison in the same manner as that in preparing the liquid developer *b*.

In the meantime, a dispersed liquid consisting of 100 g. of a finely crystallized cadmium sulfide, 10 g. of a 50% solution of a vinyl chloride-vinyl acetate copolymer in toluene and 80 g. of toluene was coated onto an aluminum foil of 0.05 mm in thickness in order that the coating might be 40 microns in thickness after drying. A polyester film of 38 microns in thickness was sticked onto the coating with an epoxy resin adhesive of cold setting type to prepare a three-layered photosensitive member.

The photosensitive member was subjected to corona charging at +7KV, and then AC corona charging was applied at 7KV simultaneously with imagewise exposure and further the whole surface was uniformly exposed to form an electrostatic latent image. The latent image was developed with the liquid developer *b* to obtain a good positive image. A transfer paper was placed on the surface bearing the image and charging was applied at +6KV from the back side. The transfer paper was peeled off so that the image on the photosensitive member was substantially perfectly transferred to the transfer paper. The transferred image was sharp with a high density, and it was perfectly fixed by means of thermal fixation.

The liquid developer containing none of the copolymers-A and B, and the sodium dodecylbenzenesulfonate which were contained in the above-mentioned liquid developers *a*, *b* and *c*, respectively was used for the foregoing development in the same manner. It was found, in this case, that the transferred image was remarkably foggy and extremely poor in the quality as well as in the image density.

The comparison test was made with respect to the image density and fog density of the images which were separately developed with the liquid developers *a*, *b* and *c* in the same manner. The liquid developers immediately after prepared and those allowed to stand for 1 month were used for the purpose. The result of the test are shown in the following table.

| Liquid developer | Liquid developer at the preparation time | | Liquid developer allowed to stand for one month | |
|---|---|---|---|---|
| | Image density | Fog density | Image density | Fog density |
| a | 1.15 | 0.02 | 1.0 | 0.03 |
| b | 1.30 | 0.02 | 1.29 | 0.02 |
| c | 0.94 | 0.04 | 0.51 | 0.05 |

From the result, the image developed with the liquid developer *b* according to this invention was found to be practicably sufficiently high in the image density, substantially free from fog and excellent in the preservation stability.

EXAMPLES 2–10

Copolymers were prepared in the same manner as in Example 1 except that the monomers having an amino group as shown in the following table were used in place of the dimethylaminoethyl methacrylate. The same comparison test as in Example 1 was carried out to obtain the following result.

| Example No. | Kind of monomer | Kind of copolymer | Liquid developer at the preparation time | | Liquid developer allowed to stand for one month | |
|---|---|---|---|---|---|---|
| | | | Image density | Fog density | Image density | Fog density |
| | Diethylaminoethyl methacrylate | A-type | 1.12 | 0.02 | 1.0 | 0.04 |
| 2 | " | Quaternary(*) | 1.30 | 0.02 | 1.28 | 0.02 |
| | N,N-dimethylaminovinyl | A-type | 1.05 | 0.02 | 0.95 | 0.04 |
| 3 | " | Quaternary(*) | 1.25 | 0.02 | 1.24 | 0.02 |
| | Diethylaminoethyl acrylate | A-type | 1.15 | 0.02 | 1.09 | 0.03 |
| 4 | " | Quaternary (*) | 1.31 | 0.02 | 1.29 | 0.02 |
| | Dimethylaminoethyl styrene | A-type | 1.0 | 0.02 | 0.85 | 0.04 |
| 5 | " | Quaternary(*) | 1.20 | 0.02 | 1.20 | 0.02 |
| | Dimethylaminoethoxy styrene | A-type | 1.02 | 0.02 | 0.87 | 0.04 |
| 6 | " | Quaternary(*) | 1.21 | 0.02 | 1.20 | 0.02 |
| | 2-vinyl pyridine | A-type | 1.0 | 0.02 | 0.82 | 0.04 |
| 7 | " | Quaternary(*) | 1.20 | 0.02 | 1.21 | 0.02 |
| | 2-vinyl quinoline | A-type | 0.98 | 0.02 | 0.80 | 0.04 |
| 8 | " | Quaternary(*) | 1.19 | 0.02 | 1.20 | 0.02 |
| | Methylaminoethyl acrylate | A-type | 1.10 | 0.02 | 1.0 | 0.04 |
| 9 | " | Quaternary(*) | 1.25 | 0.02 | 1.25 | 0.02 |
| | 4-allyl quinoline | A-type | 0.95 | 0.02 | 0.80 | 0.05 |
| | " | Quaternary(*) | 1.20 | 0.02 | 1.21 | 0.02 |

* "Quaternary" stands for a quaternary ammonium salt.

EXAMPLE 11

In the procedure of Example 1, lithium methacrylate was used in place of potassium methacrylate to prepare a copolymer of A-type and a quaternary ammonium product thereof in the same manner. The same comparison test as in Example 1 was carried out to obtain substantially the same result.

EXAMPLE 12

In Example 1, sodium methacrylate was used in place of the potassium methacrylate to prepare a copolymer of A-type and a quaternary ammonium product in the same manner. The same comparison test as in Example 1 was carried out to obtain substantially the same result.

EXAMPLE 13

In Example 1, calcium metharcylate was used in place of the potassium metharcylate to prepare a copolymer of A-type and a quaternary ammonium product thereof in the same manner. The same comparison test as in Example 1 was carried out to obtain substantially the same result.

EXAMPLE 14

In the procedure of Example 1, potassium acrylate was substituted for the potassium methacrylate to prepare a copolymer of A-type and a quaternary ammonium product thereof in the same manner. The same comparison test as in Example 1 was carried out to obtain substantially the same result.

EXAMPLE 15

In the procedure of Example 1, barium acrylate was substituted for the potassium methacrylate to prepare a copolymer of A-type and a quaternary ammonium product thereof in the same manner. The same comparison test as in Example 1 was repeated to obtain substantially the same result.

EXAMPLE 16

In Example 1, potassium itaconate was used in place of potassium methacrylate to prepare a copolymer of A-type and a quaternary ammonium product thereof in the same manner. The same comparison test as in Example 1 was carried out to obtain substantially the same result.

EXAMPLE 17

In Example 1, potassium crotonate was used in place of potassium methacrylate to prepare a copolymer of A-type and a quaternary ammonium product in the same manner. The same comparison test as in Example 1 was carried out to obtain substantially the same result.

EXAMPLE 18

In the procedure of Example 1, potassium maleate was substituted for the potassium methacrylate to prepare a copolymer of A-type and a quaternary ammonium product in the same manner. The same comparison test as in Example 1 was repeated to obtain substantially the same result.

EXAMPLE 19

In Example 1, lithium methacrylate and vinyl stearate were used in place of potassium methacrylate and stearyl methacrylate, respectively to prepare a copolymer of A-type and a quaternary ammonium product in the same manner. The same comparison test as in Example 1 was carried out to obtain substantially the same result.

EXAMPLE 20

In Example 1, lithium itaconate and dodecyl methacrylate were used in place of potassium methacrylate and stearyl methacrylate, respectively to prepare a copolymer of A-type and a quaternary ammonium product thereof in the same manner. The same comparison test as in Example 1 was carried out to obtain substantially the same result.

EXAMPLE 21

In the procedure of Example 1, lithium acrylate and tridecyl methacrylate were substituted for the potassium methacrylate and stearyl methacrylate, respectively to prepare a copolymer of A-type and a quaternary ammonium product in the same manner.

The same comparison test as in Example 1 was repeated to obtain substantially the same result.

EXAMPLE 22

In the procedure of Example 1, tridecyl vinyl ether was substituted for the stearyl methacrylate to prepare a copolymer of A-type and a quaternary ammonium product thereof in the same manner. The same comparison test as in Example 1 was repeated to obtain substantially the same result.

EXAMPLE 23

In Example 1, lauryl vinyl ether was used in place of stearyl methacrylate to prepare a copolymer of A-type and a quaternary ammonium product thereof in the same manner. The same comparison test as in Example 1 was carried out to obtain substantially the same result.

EXAMPLE 24

In the procedure of Example 1, methyl iodide was used in place of the methyl p-toluenesulfonate to synthesize a quaternary ammonium product in the same manner. The product was dissolved in 500 ml. of a mixed solution of tetrahydrofuran and carbon tetrachloride (1:1) and 80 ml. of a mixed solution of water and alcohol (1:1) containing 0.2 mole of potassium hydroxide was added thereto. The resulting mixture was stirred at a room temperature for 2 hours and then a product was caused to separate out by means of a 20% water-containing methanol, washed with alcohol and dried so that the above-mentioned quaternary ammonium product prepared by using methyl iodide was formed into a quaternary ammonium hydroxide product.

The quaternary ammonium product and quaternary ammonium hydroxide product which were obtained in the foregoing manner were used to carry out the same comparison test as in Example 1 so that the following result was obtained.

| Example No. | Kind of quaternized product | Liquid developer at the preparation time | | Liquid developer allowed to stand for one month | |
|---|---|---|---|---|---|
| | | Image density | Fog density | Image density | Fog density |
| 1 | (*1) | 1.30 | 0.02 | 1.29 | 0.02 |
| 24 | (*2) | 1.29 | 0.02 | 1.29 | 0.02 |
| 24 | (*3) | 1.31 | 0.02 | 1.30 | 0.02 |

*1 Quaternary ammonium salt prepared by using methyl p-toluene-sulfonate.
*2 Quaternary ammonium salt prepared by using methyl iodide.
*3 Quaternary ammonium hydroxide.

EXAMPLE 25

In Example 1, methyl bromide was used in place of methyl p-toluenesulfonate to prepare a quaternary ammonium compound in the same manner. The same comparison test as in Example 1 was carried out to obtain substantially the same result.

EXAMPLE 26

In the procedure of Example 1, dimethyl sulfate was substituted for the methyl p-toluenesulfonate to prepare a quaternary ammmonium compound in the same manner. The same comparison test as in Example 1 was repeated to obtain substantially the same result.

EXAMPLE 27

The quaternary ammonium salt compounds obtained in Examples 11–23 were formed into quaternary ammonium hydroxides in the same manner as in Example 24. The quaternary ammonium hydroxides thus obtained were used to repeat the same comparison test as in Example 24 so that substantially the same result was obtained.

EXAMPLE 28

In the procedure of Example 1, trimethylammonio ethylmethacrylate p-toluenesulfonate was used in place of the dimethylaminoethyl methacrylate to prepare a copolymer-E in the same manner as in the preparation of the copolymer-A. The copolymer-E was used to prepare a liquid developer *e* in the same manner as in the preparation of the liquid developer *b*. The liquid developer *e* was found to have the same property as that of the liquid developer *b*.

I claim:

1. A liquid developer for use in development of an electrostatic latent image comprising an electrically insulating carrier liquid and a toner dispersed therein, the liquid developer comprising a copolymer wherein the amino group thereof is converted into a quaternary ammonium salt or a quaternary ammonium hydroxide, the copolymer being composed of at least one member selected from the monomers of the following formula (1), at least one member selected from the monomers of the following formula (2) and at least one member selected from the monomers of the following formula (3), Formula (1):

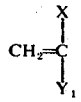

wherein X is selected from the class of —H and —$CH_3$ and $Y_1$ is selected from the class of —$C_nH_{2n+1}$, —$OC_nH_{2n+1}$ and —$COOC_nH_{2n+1}$ in which $n$ is from 8 to 20, wherein the monomer of formula (1) is present in a mole ratio sufficient to prevent a decrease in the solubility of the copolymer in said carrier liquid;

Formula (2):

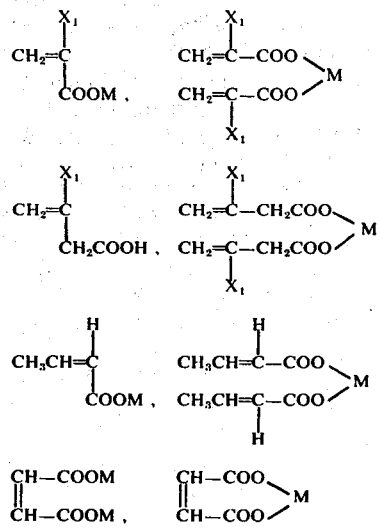

wherein $X_1$ is selected from the class of —H, —$CH_3$ and —COOM and M is selected from the class of an alkali metal and alkaline earth metal.

Formula (3):

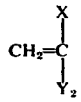

wherein X is selected from the class of —H and —$CH_3$ and $Y_2$ is selected from the class of the following substituents:

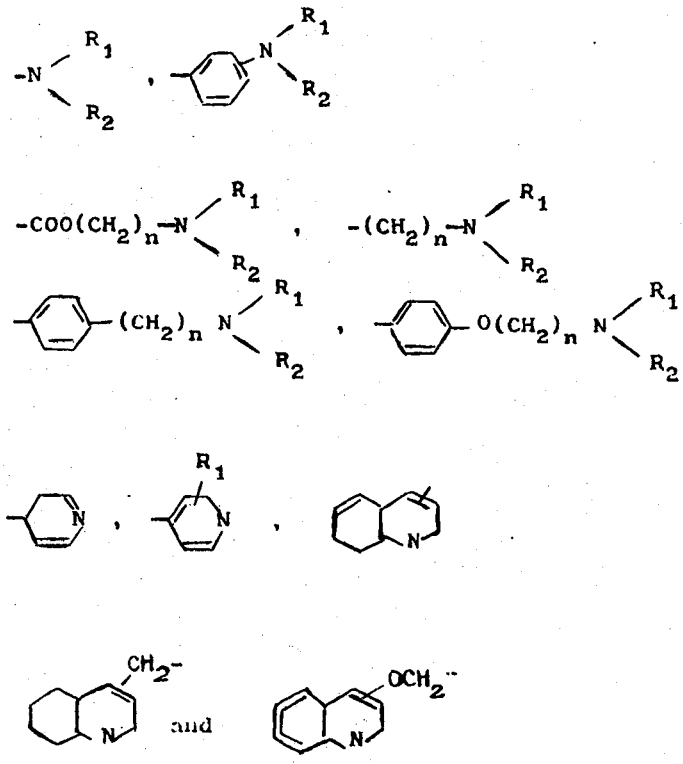

wherein $1 \leqq n \leqq 4$; $R_1$ and $R_2$ are similar or dissimilar, selected from the class of —H and $-C_mH_{2m+1}$; and $1 \leqq m \leqq 4$.

2. A liquid developer for use in development of an electrostatic latent image according to claim 1, in which said electrically insulating carrier liquid is an organic solvent having a volume resistivity of $10^9$ohm-cm or above and a dielectric constant of 3 or less.

3. A liquid developer for use in development of an electrostatic latent image according to claim 1, in which said toner is composed of particles comprising a pigment and resin.

4. A liquid developer for use in development of an electrostatic latent image according to claim 1, in which said copolymer is contained in an amount ranging from 0.001 g. to 10 g. in 1 liter of the electrically insulating carrier liquid.

5. A liquid developer for use in development of an electrostatic latent image according to claim 1, in which said copolymer is contained in an amount ranging from 0.005 g. to 1.0 g. in 1 liter of the electrically insulating carrier liquid.

6. A liquid developer for use in development of an electrostatic latent image according to claim 1, in which the monomer of the formula (1) is selected from the class of vinyl laurate, vinyl oleate, vinyl stearate, dodecyl acrylate, octyl acrylate, stearyl acrylate, tridecyl acrylate, hexadecyl acrylate, dodecyl methacrylate, heptadecyl methacrylate, stearyl methcarylate, lauryl vinyl ether, n-octyl vinyl ether and tridecyl vinyl ether.

7. A liquid developer for use in development of an electrostatic latent image according to claim 1, in which the monomer of the formula (2) is selected from the class of sodium acrylate, potassium acrylate, lithium acrylate, sodium methacrylate, potassium methacrylate, lithium methacrylate, sodium itaconate, potassium itaconate, lithium itaconate, sodium crotonate, potassium crotonate, lithium crotonate, sodium maleate, potassium maleate, lithium maleate, calcium acrylate, barium acrylate, calcium methacrylate, barium methacrylate, calcium itaconate, barium itaconate, calcium crotonate, barium crotonate, calcium maleate and barium maleate.

8. A liquid developer for use in development of an electrostatic latent image according to claim 1, in which the monomer of the formula (3) is selected from the class of aminostyrene, allylamine, allyl methylamine, N-methyl-aminoethyl acrylate, N-ethylaminoethyl acrylate, N-methylaminoethyl methacrylate, N-ethylaminoethyl methacrylate, N,N-dimethylamino vinyl, N,N-dimethylaminoethyl acrylate, N,N-diethylaminoethyl acrylate, N,N-dimethylaminoethyl methacrylate, N,N-diethylaminoethyl methacrylate, N-vinyl pyridine, 2-vinyl-5-methyl pyridine, dimethylaminoethyl styrene, N-methylaminoethyl styrene, dimethylaminoethoxy styrene, 2-vinyl quinoline, 4-vinyl quinoline, 2-allyl quinoline and 4-allyl quinoline.

* * * * *

UNITED STATES PATENT OFFICE

CERTIFICATE OF CORRECTION

PATENT NO. : 3,977,983

DATED : August 31, 1976

INVENTOR(S) : Terukuni Tsuneda

It is certified that error appears in the above-identified patent and that said Letters Patent are hereby corrected as shown below:

Column 4, line 45, "wherein 1 n 4" should read -- wherein $1 \leq n \leq 4$ -- .

Column 4, line 47, "and 1 m 4." should read -- and $1 \leq m \leq 4$. --.

Column 5, line 32, "LAKE) first occurrence should read -- LAKE --.

Column 9, table 2, line 57 add -- 10 -- before "4-allyl" .

Column 14, line 10, "$CH_2COOH$" should read -- $CH_2COOM$ --.

Column 10, lines 11 and 12, in each, "metharcylate" should read -- methacrylate-- .

Signed and Sealed this

First Day of February 1977

[SEAL]

*Attest:*

RUTH C. MASON
*Attesting Officer*

C. MARSHALL DANN
*Commissioner of Patents and Trademarks*

UNITED STATES PATENT OFFICE
CERTIFICATE OF CORRECTION

Patent No. 3,977,983 Dated August 31, 1976

Inventor(s) TERUKUNI TSUNEDA

It is certified that error appears in the above-identified patent and that said Letters Patent are hereby corrected as shown below:

Claim 1, Column 14, line 55-68, delete the last five structural formula and substitute the following structural formula:

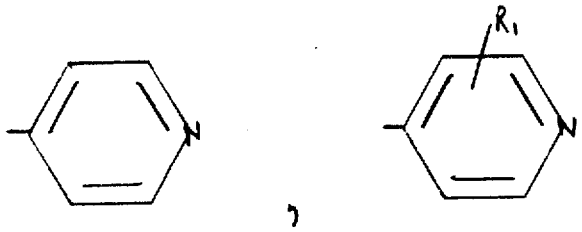

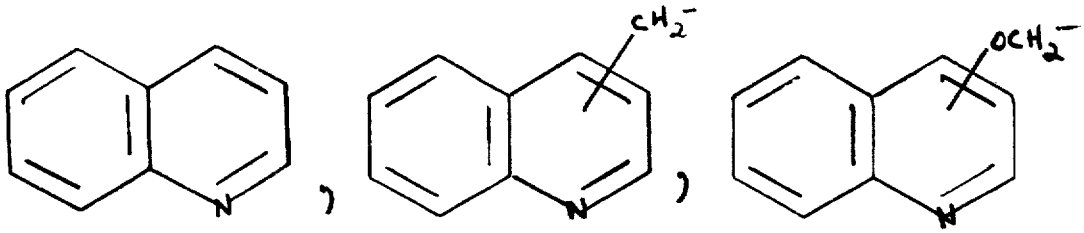

Signed and Sealed this

Eighth Day of March 1977

[SEAL]

*Attest:*

RUTH C. MASON
*Attesting Officer*

C. MARSHALL DANN
*Commissioner of Patents and Trademarks*